US009395685B2

(12) United States Patent
Matsuno

(10) Patent No.: US 9,395,685 B2
(45) Date of Patent: Jul. 19, 2016

(54) FIXING DEVICE PROVIDED WITH POSITIONING MEMBER CAPABLE OF POSITIONING HEATING UNIT WITH RESPECT TO PRESSURE ROLLER

(71) Applicant: Brother Kogyo Kabushiki Kaisha, Nagoya-shi, Aichi-ken (JP)

(72) Inventor: Takuji Matsuno, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/497,430

(22) Filed: Sep. 26, 2014

(65) Prior Publication Data

US 2015/0093159 A1 Apr. 2, 2015

(30) Foreign Application Priority Data

Sep. 27, 2013 (JP) ..... 2013-201335

(51) Int. Cl.
*G03G 21/16* (2006.01)

(52) U.S. Cl.
CPC ..... *G03G 21/1685* (2013.01); *G03G 21/1647* (2013.01); *G03G 2215/2035* (2013.01)

(58) Field of Classification Search
CPC ..... G03G 15/2064; G03G 21/1685; G03G 15/2089; G03G 2215/2012; G03G 2215/2035; G03G 2215/2038; G03G 2221/1639; G03G 2221/1654; G03G 2215/00151
See application file for complete search history.

(56) References Cited

U.S. PATENT DOCUMENTS

| | | | | |
|---|---|---|---|---|
| 7,235,761 | B1 * | 6/2007 | Maul et al. | 219/216 |
| 8,843,043 | B2 * | 9/2014 | Iwaya et al. | 399/329 |
| 2005/0249531 | A1 * | 11/2005 | Chung et al. | 399/328 |
| 2006/0133868 | A1 * | 6/2006 | Kobayashi et al. | 399/328 |
| 2011/0170920 | A1 | 7/2011 | Fujiwara et al. | |
| 2012/0219324 | A1 * | 8/2012 | Masuda | 399/122 |
| 2013/0136512 | A1 * | 5/2013 | Suzuki et al. | 399/329 |
| 2013/0319825 | A1 * | 12/2013 | Takahashi | 198/617 |
| 2014/0105633 | A1 * | 4/2014 | Takahashi | 399/90 |
| 2014/0186074 | A1 * | 7/2014 | Ishida | 399/122 |
| 2014/0233995 | A1 * | 8/2014 | Kasuya et al. | 399/329 |
| 2014/0241769 | A1 * | 8/2014 | Tanto et al. | 399/329 |
| 2014/0348542 | A1 * | 11/2014 | Yoshida | 399/122 |

FOREIGN PATENT DOCUMENTS

JP 2011-137933 A 7/2011

* cited by examiner

*Primary Examiner* — Clayton E Laballe
*Assistant Examiner* — Ruifeng Pu
(74) *Attorney, Agent, or Firm* — Banner & Witcoff, Ltd.

(57) ABSTRACT

A fixing device includes: a heating unit; a rotatable body; an urging mechanism; first and second bearings; a frame; first and second positioning members. The first and second bearings support first and second axial end portions of the rotatable body, respectively. The frame supports the heating unit and has two side walls. One of the side walls supports the first bearing, and the other supports the second bearing. Each side wall includes: a first wall portion supporting the first or second bearing; and second and third wall portions supporting the heating unit while interposing the heating unit therebetween. The first and second positioning members extend from the heating unit toward the first and second bearings, respectively. The heating unit is fixed in position relative to the first and second bearings upon engagement of the first and second positioning members with the first and second bearings, respectively.

18 Claims, 7 Drawing Sheets

FIXING DEVICE PROVIDED WITH POSITIONING MEMBER CAPABLE OF POSITIONING HEATING UNIT WITH RESPECT TO PRESSURE ROLLER

CROSS REFERENCE TO RELATED APPLICATION

This application claims priority from Japanese Patent Application No. 2013-201335 filed Sep. 27, 2013. The entire content of the priority application is incorporated herein by reference.

TECHNICAL FIELD

The present invention relates to a fixing device that thermally fixes a transferred developer image to a sheet.

BACKGROUND

There is conventionally known a fixing device that includes a heating unit; a pressure roller; a frame; and an urging mechanism. The heating unit includes a heater. The pressure roller conveys a sheet while nipping the sheet in cooperation with the heating unit. The frame supports the heating unit such that the heating unit is movable in a direction toward and away from the pressure roller. The urging mechanism urges the heating unit toward the pressure roller.

More specifically, in this fixing device, the frame has a pair of side walls disposed on respective sides of the pressure roller in an axial direction thereof. Each side wall has a first wall portion and a pair of second wall portions to provide a generally U-shape. The first wall portion rotatably supports axial end portions of the pressure roller through bearing members. The pair of second wall portions protrudes from the first wall portion toward the heating unit, and supports the heating unit, interposing the heating unit therebetween in a sheet conveyance direction. Each axial end portion of the heating unit is interposed between the respective pair of second wall portions. Hence, the heating unit is fixed in position with respect to the pressure roller in the sheet conveyance direction.

SUMMARY

However, in the conventional fixing device, if a clearance between the pair of second wall portions in one of the side walls becomes greater due to, for example, thermal deformation, the position of one of the axial end portions of the heating unit might be displaced in the sheet conveyance direction. When this sort of problem occurs, the heating unit could tilt in the sheet conveyance direction with respect to an axis of the pressure roller. Tilting of the heating unit causes wrinkling of the sheet being conveyed between the heating unit and the pressure roller.

In view of the foregoing, it is an object of the present invention to provide a fixing device capable of preventing a heating unit from tilting with respect to an axis of a pressure roller (rotatable body).

In order to attain the above and other objects, the present invention provides a fixing device that may include: a heating unit; a rotatable body; an urging mechanism; a first bearing; a second bearing; a frame; a first positioning member; and a second positioning member. The heating unit may include a heater. The rotatable body may be disposed to face the heating unit. The rotatable body may be configured to rotate about an axis thereof and have a first axial end portion and a second axial end portion. The urging mechanism may be configured to urge the heating unit toward the rotatable body. The first bearing may be configured to rotatably support the first axial end portion of the rotatable body. The second bearing may be configured to rotatably support the second axial end portion of the rotatable body. The frame may be configured to movably support the heating unit and have a pair of side walls. One of the pair of side walls may be configured to support the first bearing. The other of the pair of side walls may be configured to support the second bearing. Each of the pair of side walls may include: a first wall portion configured to support corresponding one of the first bearing and the second bearing; a second wall portion configured to movably support the heating unit; and a third wall portion configured to movably support the heating unit while interposing the heating unit between the second wall portion and the third wall portion. The first positioning member may extend from the heating unit toward the first bearing and be configured to be engaged with the first bearing. The heating unit may be fixed in position relative to the first bearing upon engagement of the first positioning member with the first bearing. The second positioning member may extend from the heating unit toward the second bearing and be configured to be engaged with the second bearing. The heating unit may further be fixed in position relative to the second bearing upon engagement of the second positioning member with the second bearing.

DETAILED DESCRIPTION

Figure 1:
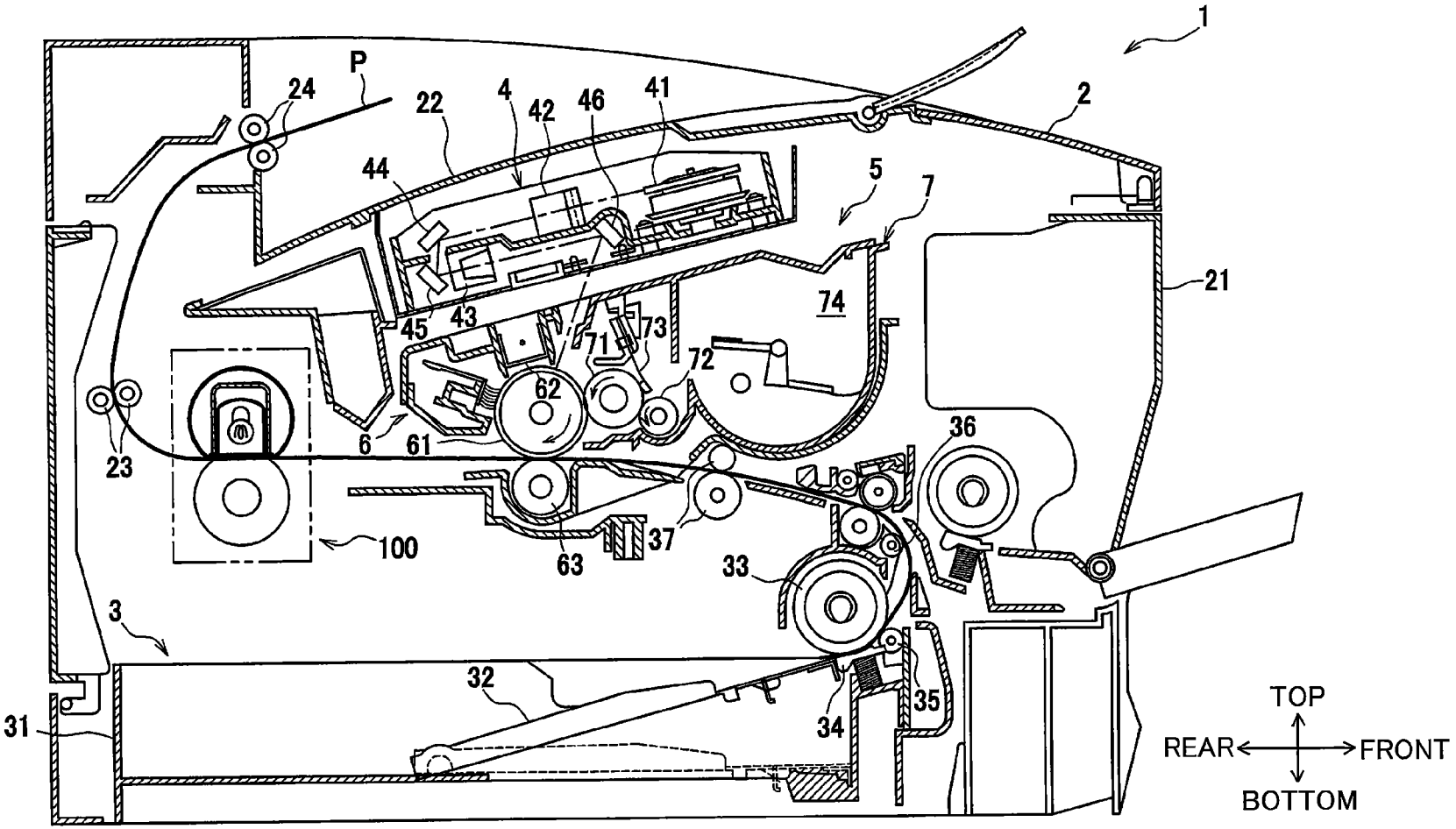
FIG. 1 is a schematic cross-sectional view of a laser printer provided with a fixing device according to one embodiment of the present invention.

Next, a general structure of a laser printer 1 provided with a fixing device 100 according to one embodiment of the present invention will be described with reference to FIG. 1. A detailed structure of the fixing device 100 will be described later while referring to FIGS. 2 through 6, wherein like parts and components are designated by the same reference numerals to avoid duplicating description.

Throughout the specification, the terms "upward", "downward", "upper", "lower", "above", "below", "beneath", "right", "left", "front", "rear" and the like will be used assuming that the laser printer 1 is disposed in an orientation in which it is intended to be used. More specifically, in FIG. 1, a left side and a right side are a rear side and a front side, respectively. Further, in FIG. 1, a far side and a near side are a right side and a left side, respectively. That is, the left and right sides of the laser printer 1 will be based on the perspective of a user facing the front side of the laser printer 1. Further, in FIG. 1, a top side and a bottom side are a top side and a bottom side, respectively.

<General Structure of Laser Printer>

As illustrated in FIG. 1, the laser printer 1 includes a main casing 2 having a front cover 21. The front cover 21 covers an opening formed in the main casing 2 at its closed position and exposes the opening at its open position. The laser printer 1 further includes, within the main casing 2, a sheet supply unit 3 for supplying a sheet P, an exposure unit 4, a process cartridge 5 for transferring a toner image onto the sheet P, and the fixing device 100 for thermally fixing the toner image on the sheet P.

The sheet supply unit 3 is disposed in the main casing 2 at a bottom portion thereof. The sheet supply unit 3 includes a sheet supply tray 31 for accommodating the sheets P, a lifter plate 32 for lifting up front edges of the sheets P, a sheet supply roller 33, a sheet supply pad 34, paper dust removing rollers 35, 36, and a pair of registration rollers 37. The sheets P accommodated in the sheet supply tray 31 are directed toward the sheet supply roller 33 by the lifter plate 32 and are separated one by one by the sheet supply roller 33 and the sheet supply pad 34. Each separated sheet P is conveyed toward the process cartridge 5, passing through the paper dust removing rollers 35, 36, and the registration rollers 37.

The exposure unit 4 is disposed in the main casing 2 at a top portion thereof. The exposure unit 4 includes a laser emission unit (not illustrated), a rotatably driven polygon minor 41, lenses 42, 43, and reflection mirrors 44, 45, 46. In the exposure unit 4, a laser beam (indicated by a dashed line in FIG. 1) based on image data emitted from the laser emission unit scans a surface of a photosensitive drum 61 (described later) at a high speed, after passing through or reflected by the polygon mirror 41, the lens 42, the reflection mirrors 44, 45, the lens 43, and the reflection minor 46 in this order.

The process cartridge 5 is disposed below the exposure unit 4. The process cartridge 5 is detachable from and attachable to the main casing 2 through the opening formed in the main casing 2. The process cartridge 5 includes a drum unit 6 and a developing unit 7.

The drum unit 6 includes the photosensitive drum 61, a charger 62, and a transfer roller 63. The developing unit 7 is detachably mountable relative to the drum unit 6. The developing unit 7 includes a developing roller 71, a supply roller 72, a layer thickness regulation blade 73, and a toner accommodating portion 74 for accommodating toner (developer) therein.

In the process cartridge 5, the surface of the photosensitive drum 61 is exposed by high speed scan of the laser beam emitted from the exposure unit 4 after the charger 62 applies a uniform charge to the surface of the photosensitive drum 61. As a result, an electrostatic latent image based on the image data is formed on the photosensitive drum 61. At this time, the toner accommodated in the toner accommodating portion 74 is supplied to the developing roller 71 through the supply roller 72. The toner supplied to the developing roller 71 becomes a thin layer having a uniform thickness by the layer thickness regulation blade 73 in accordance with rotation of the developing roller 71.

The toner carried on the developing roller 71 is supplied to the electrostatic latent image formed on the photosensitive drum 61 as the photosensitive drum 61 rotates. As a result, a visible toner image corresponding to the electrostatic latent image is formed on the photosensitive drum 61. Subsequently, the toner image formed on the photosensitive drum 61 is transferred onto the sheet P while the sheet P is conveyed between the photosensitive drum 61 and the transfer roller 63.

The fixing device 100 is disposed rearward of the process cartridge 5. The toner image transferred onto the sheet P is thermally fixed thereon while the sheet P passes through the fixing device 100. The sheet P onto which the toner image has been thermally fixed is discharged on a discharge tray 22 by conveying rollers 23, 24.

<Detailed Structure of Fixing Device>

Figure 2:
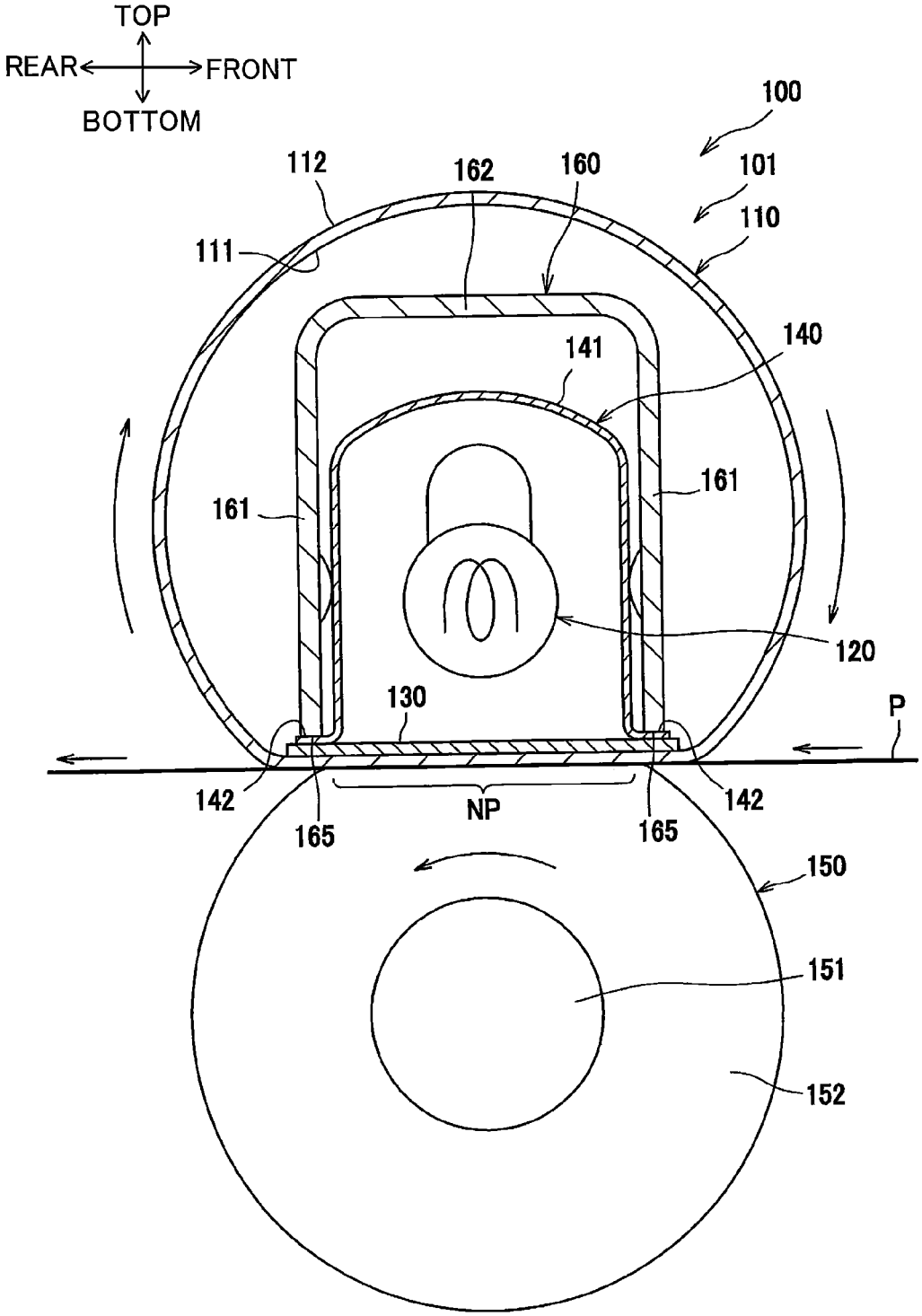
FIG. 2 is a cross-sectional view of the fixing device taken along a plane perpendicular to a left-right direction.
Figure 3:
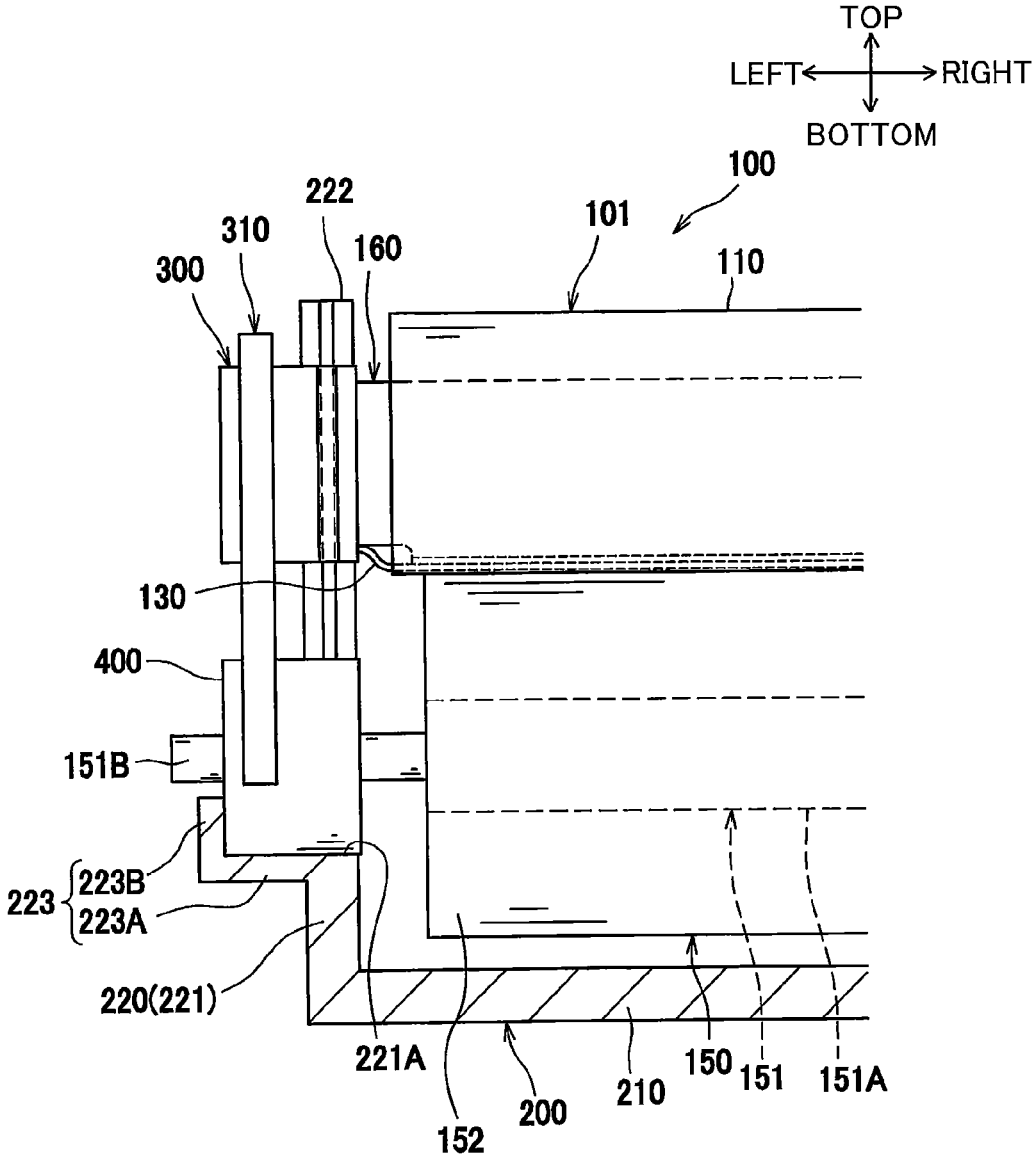
FIG. 3 is a cross-sectional view of a left portion of the fixing device taken along a plane perpendicular to a front-rear direction.

As illustrated in FIGS. 2 and 3, the fixing device 100 includes a heating unit 101, a pressure roller 150 as an example of a rotatable body, and a frame 200. The fixing device 100 has a substantially left-right symmetric structure. Thus, in FIGS. 3, 5 and 7, only a left portion of the fixing device 100 is illustrated.

The heating unit 101 includes a fusing belt 110, a halogen lamp 120 as an example of a heater, a nip plate 130, a reflection plate 140, a stay 160, a pair of left and right supporting members 300, and a pair of left and right positioning members 310.

As illustrated in FIG. 2, the fusing belt 110 is an endless belt having flexibility and heat-resistivity. The fusing belt 110 has a metallic tube made of metal such as stainless steel, and a fluorine resin layer covering the metallic tube. The fusing belt 110 is circularly movable about an axis extending in the left-right direction and has a generally tubular configuration. The fusing belt 110 has an inner peripheral surface 111 that moves in sliding contact with the nip plate 130, and an outer peripheral surface 112 that moves in sliding contact with the pressure roller 150.

Incidentally, the fusing belt 110 may have a rubber layer between the metallic tube and the fluorine resin layer.

The halogen lamp 120 is a heater that generates a radiant heat. The halogen lamp 120 is disposed in an internal space defined by the inner peripheral surface 111 of the fusing belt 110, with a prescribed distance from the inner peripheral surface 111 of the fusing belt 110 and also with a prescribed distance from an inner surface (i.e. upper surface) of the nip plate 130. The halogen lamp 120 heats the fusing belt 110 indirectly through the nip plate 130.

The nip plate 130 is formed in a substantially plate-like shape that is elongated in a left-right direction. The nip plate 130 is disposed such that the inner peripheral surface 111 of the tubular fusing belt 110 is in sliding contact with the nip plate 130. The nip plate 130 is adapted to transfer the radiant heat from the halogen lamp 120 to the toner on the sheet P through the fusing belt 110.

The nip plate 130 is made of a metallic material such as aluminum having a thermal conductivity higher than that of the stay 160 (described later) made of steel. Incidentally, the nip plate 130 may further include a metal oxide film or a fluorine resin layer formed over a surface of the nip plate 130 that is in contact with the inner peripheral surface 111 of the fusing belt 110.

The reflection plate 140 is adapted to reflect the radiant heat from the halogen lamp 120 toward the nip plate 130. The reflection plate 140 is disposed in the internal space of the fusing belt 110. More specifically, the reflection plate 140 is disposed away from the halogen lamp 120 with a prescribed distance therefrom and surrounds the halogen lamp 120 at a position between the halogen lamp 120 and the stay 160 (described later).

Thus, the radiant heat from the halogen lamp 120 can be efficiently concentrated onto the nip plate 130 by the reflection plate 140 to promptly heat the nip plate 130 and the fusing belt 110.

The reflection plate 140 has a generally U-shaped cross-section and is made of a material such as aluminum having high reflection ratio regarding an infrared ray and a far infrared ray. More specifically, the reflection plate 140 has a reflection portion 141 having a generally U-shaped cross-section, and flange portions 142 respectively extending outward in a front-rear direction from both front and rear end portions of the reflection portion 141. Incidentally, in order to enhance the heat reflection ratio of the reflection plate 140, the reflection plate 140 may be formed by an aluminum plate to which a minor surface finishing is applied.

The stay 160 is a member for ensuring rigidity of the nip plate 130 by supporting both front and rear end portions of the nip plate 130 through the flange portions 142 of the reflection plate 140. The stay 160 is disposed opposite to a nip region NP with respect to the nip plate 130. The stay 160 has a generally U-shaped cross-section in conformity with an outer shape of the reflection plate 140 (reflection portion 141) and is disposed so as to cover the reflection plate 140. For fabricating the stay 160, a steel plate or any other plate having high rigidity is folded into a generally U-shape in cross-section.

The stay 160 includes a pair of front and rear first walls 161, and a second wall 162. The first walls 161 face each other in the front-rear direction. The second wall 162 is integral with the first walls 161 and connected to respective upper ends of the first walls 161. At each of left and right ends of the stay 160, the supporting member 300 for supporting the stay 160 and the positioning member 310 fixed to the supporting member 300 are provided (see FIG. 3). The supporting member 300 and the positioning member 310 will be described in detail later.

In this embodiment, the nip plate 130 and the reflection plate 140 are engaged with the stay 160 and supported by the supporting members 300 through the stay 160, and the halogen lamp 120 is directly supported by the supporting members 300. Incidentally, the nip plate 130 and the reflection plate 140 may be supported directly by the supporting members 300. In a case where holes are formed in the supporting members 300 to allow the respective left and right ends of the halogen lamp 120 to penetrate therethrough, the halogen lamp 120 may be supported by the main casing 2 through these holes.

The pressure roller 150 is a resiliently deformable member. The pressure roller 150 is disposed below the nip plate 130 so as to oppose the outer peripheral surface 112 of the fusing belt 110 in a vertical direction. The pressure roller 150 is rotatable about an axis extending in the left-right direction. The resiliently deformed pressure roller 150 nips the fusing belt 110 in cooperation with the nip plate 130 to provide the nip region NP between the pressure roller 150 and the fusing belt 110.

The pressure roller 150 includes a shaft 151 made of metal, and a rubber layer 152 formed over an outer periphery of the shaft 151. As illustrated in FIG. 3, the shaft 151 has a portion 151A over which the rubber layer 152 is provided, and left and right end portions 151B over which the rubber layer 152 is not provided. The diameter of the left and right end portions 151B is smaller than the diameter of the portion 151. Further, the respective left-right end portions 151B of the shaft 151 are rotatably supported by a pair of left and right bearing members 400 as an example of a first bearing and a second bearing. Each of the left and right bearing portions 400 is formed into a cylindrical shape and disposed so as to be coaxial with the axis of the pressure roller 150.

The pressure roller 150 is driven to rotate upon transmission of a driving force from a motor (not illustrated) provided in the main casing 2. By the rotation of the pressure roller 150, the fusing belt 110 is circularly moved due to a friction force generated between the pressure roller 150 and the fusing belt 110 or between the sheet P and the fusing belt 110. In this way, while the sheet P onto which the toner image has been transferred is conveyed between the pressure roller 150 and the heated fusing belt 110, the toner image is thermally fixed to the sheet P.

The frame 200 is made of resin. As illustrated in FIG. 3, the frame 200 has a lower wall 210, and a pair of left and right side walls 220 (note that the right side wall 220 is not illustrated in FIG. 3). The lower wall 210 extends in the left-right direction. The left and right side walls 220 extend upward from left and right ends of the lower wall 210, respectively.

Figure 4:
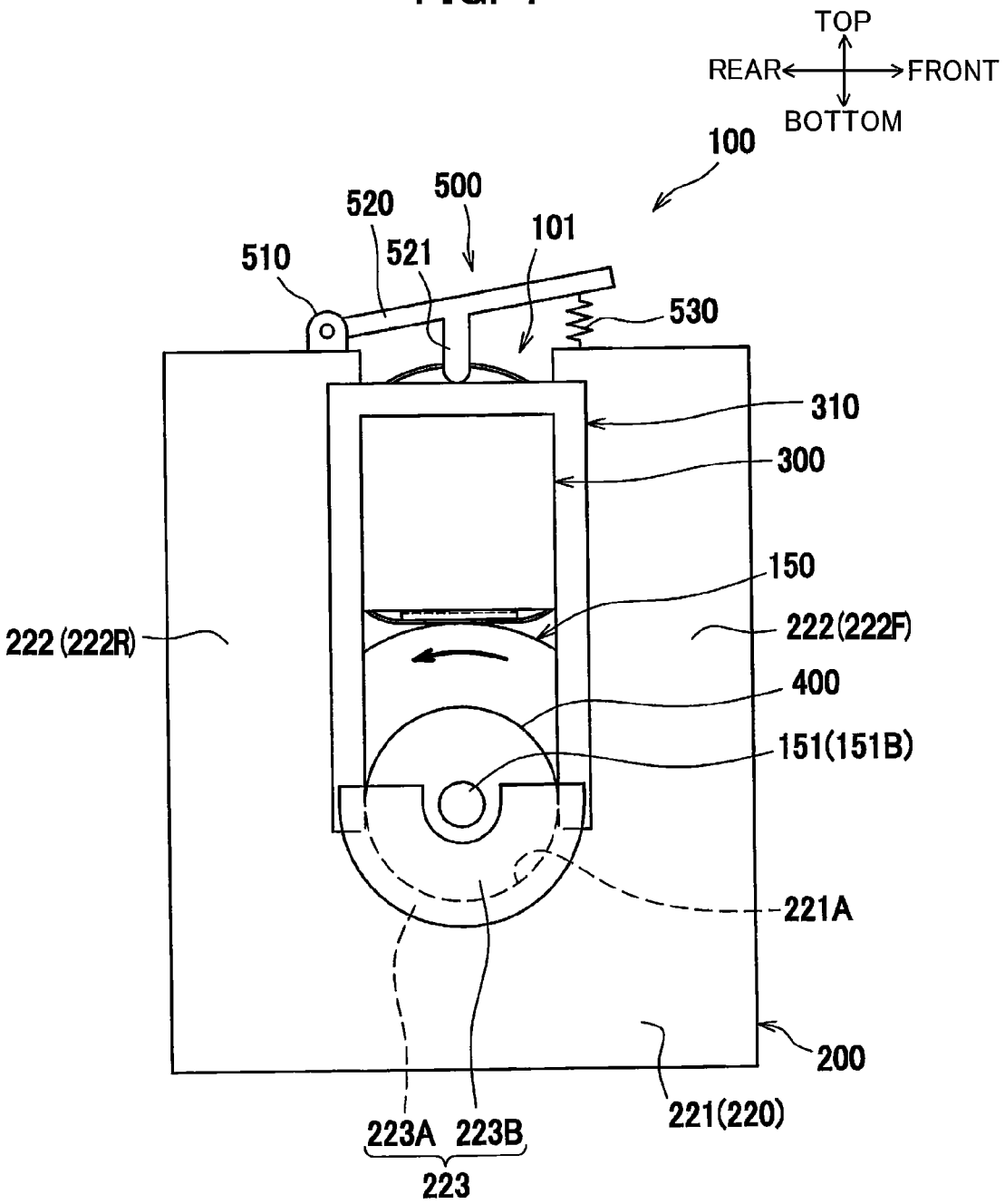
FIG. 4 is a left side view of the fixing device.

As illustrated in FIG. 4, each of the left and right side walls 220 is formed into a generally U-shape as viewed in the left-right direction (note that only the left side wall 220 is illustrated in FIG. 4). Each of the left and right side walls 220 has a first wall portion 221, and a pair of front and rear second wall portions 222. Hereinafter, the second wall portion 222 on the front side will be referred to as the front second wall portion 222F as an example of a third wall portion, and the second wall portion 222 on the rear side will be referred to as the rear second wall portion 222R as an example of a second wall portion, when it is necessary to distinguish between the two.

The first wall portion 221 constitutes a lower portion of the side wall 220. The first wall portion 221 is formed into a generally rectangular shape that is elongated in the front-rear direction. The first wall portion 221 has a concave portion 221A and a bearing supporting portion 223 at its upper center portion. The concave portion 221A and the bearing supporting portion 223 are adapted to hold the corresponding bearing member 400 provided at the shaft 151.

As illustrated in FIG. 4, the concave portion 221A has an arcuate-shaped cross-section.

As illustrated in FIGS. 3 and 4, the bearing supporting portion 223 has a peripheral surface supporting portion 223A and an endface supporting portion 223B. The peripheral surface supporting portion 223A has an arcuate-shaped cross-section and protrudes outward in the left-right direction from a periphery of the concave portion 221A. The endface supporting portion 223B has a generally U-shaped cross-section and extends toward the shaft 151 from an outer left-right end of the peripheral surface supporting portion 223A.

The concave portion 221A and the peripheral surface supporting portion 223A has a peripheral surface that conforms to a part of an outer peripheral surface of the bearing member 400. The bearing member 400 is supported by the peripheral surface of the combination of the concave portion 221A and the peripheral surface supporting portion 223A.

The endface supporting portion 223B is in contact with an endface of the corresponding bearing member 400 to restrict movement of the bearing member 400 outward in the left-right direction. The bearing member 400 is fixed to the corresponding bearing supporting portion 223 by, for example, adhesion using an adhesive agent, welding, or fastening using a screw.

Figure 5:
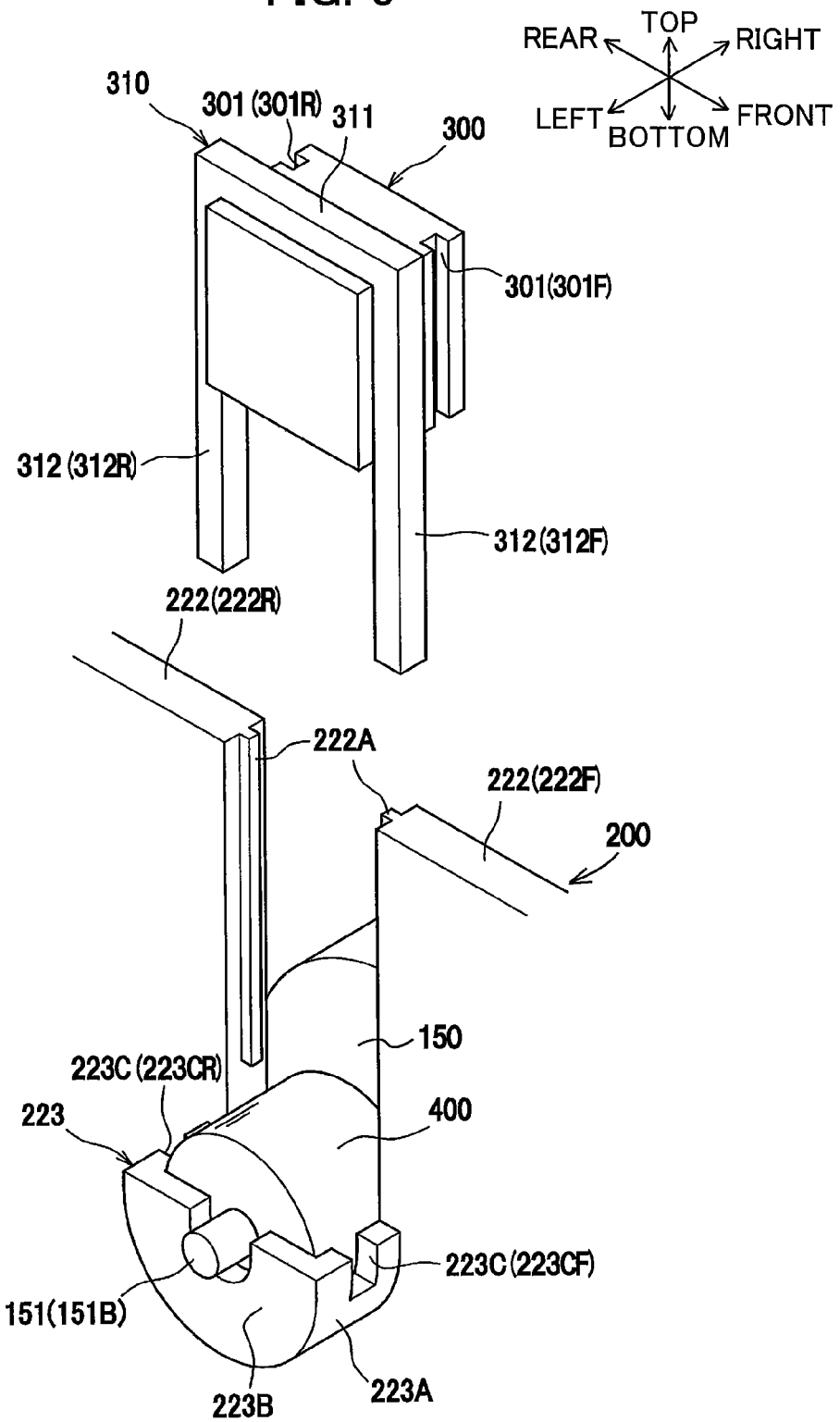
FIG. 5 is a partial perspective view of the fixing device, in which a supporting member and a positioning member are separated from a frame.

As illustrated in FIG. 5, the peripheral surface supporting portion 223A is formed with a pair of front and rear grooves 223C for allowing a pair of front and rear arm portions 312 (described later) of the positioning member 310 (described later) to be engaged with the corresponding bearing member 400.

Each groove 223C is formed so as to penetrate through the peripheral surface supporting portion 223A in the front-rear direction and to open upward. In other words, the groove 223C is recessed downward into the peripheral surface supporting portion 223A. The bottom of the groove 223C is disposed lower than a central axis of the bearing member 400 supported by the peripheral surface supporting portion 223A.

Hereinafter, the groove 223C on the front side will be referred to as the front groove 223CF, and the groove 223C on the rear side will be referred to as the rear groove 223CR, when it is necessary to distinguish between the two.

With this configuration, a lower end of each arm portion 312 of the positioning member 310 can be moved to a position lower than the central axis of the bearing member 400. Hence, the bearing member 400 can be interposed between the corresponding pair of front and rear arm portions 312.

The pair of front and rear second wall portions 222 extends upward (i.e. toward the heating unit 101) from the first wall portion 221 such that the front second wall portion 222F extends upward from a front end portion of the first wall portion 221 and the rear second wall portion 222R extends upward from a rear end portion of the first wall portion 221.

Each pair of the front and rear second wall portions 222 movably supports the corresponding supporting member 300 of the heating unit 101, interposing the supporting member 300 between the front second wall portion 222F and the rear second wall portion 222R in the front-rear direction. As illustrated in FIG. 5, each of the front second wall portion 222F and the rear second wall portion 222R has an inner front-rear surface at which a guide rib 222A is formed. The guide rib 222A protrudes inward from the inner front-rear surface in the front-rear direction and extends in the vertical direction. More specifically, the guide rib 222A formed on the rear surface of the front second wall portion 222F protrudes rearward, while the guide rib 222A formed on the front surface of the rear second wall portion 222R protrudes frontward. The guide rib 222A formed on the front surface of the rear second wall portion 222R is an example of a first guide rib or a second guide rib.

Each of the left and right supporting members 300 as an example of a first supporting member or a second supporting member has two guide grooves 301. One of the guide grooves 301 is formed on a front surface of the supporting member 300, and another of the guide grooves 301 is formed on a rear surface of the supporting member 300. Hereinafter, the guide groove 301 formed on the front surface of the supporting member 300 will be referred to as the front guide groove 301F, and the guide groove 301 formed on the rear surface of the supporting member 300 will be referred to as the rear guide groove 301R (as an example of a first guide groove or a second guide groove), when it is necessary to distinguish between the two. Each guide groove 301 is formed so as to penetrate the supporting member 300 in the vertical direction and to open outward in the front-rear direction. More specifically, the front guide groove 301F is recessed rearward into the supporting member 300, and the rear guide groove 301R is recessed frontward into the supporting member 300. Each guide rib 222A is insertable into the corresponding guide groove 301.

Each of the left and right positioning members 310 as an example of a first positioning member or a second portioning member has a base portion 311 as an example of a first base portion or a second base portion, and the pair of front and rear arm portions 312 as an example of a pair of first arm portions or a pair of second arm portions. Hereinafter, the arm portion 312 on the front side will be referred to as the front arm portion 312F, and the arm portion 312 on the rear side will be referred to as the rear arm portion 312R, when it is necessary to distinguish between the two.

The base portion 311 extends in the front-rear direction. The base portion 311 is disposed on an upper surface of the corresponding supporting member 300. Front and rear end portions of the base portion 311 protrude further outward in the front-rear direction than the front and rear surfaces of the supporting member 300, respectively.

The pair of front and rear arm portions 312 extends downward (i.e. toward the bearing member 400) from the base portion 311 such that the front arm portion 312F extends downward from a front end portion of the base portion 311 and the rear arm portion 312R extends downward from a rear end portion of the base portion 311. The pair of front and rear arm portions 312 is formed so as to extend further downward than a lower surface of the corresponding supporting member 300.

The lower end of the front arm portion 312F is inserted into the front groove 223CF of the bearing supporting portion 223, while the lower end of the rear arm portion 312R is inserted into the rear groove 223CR. Hence, the bearing member 400 is interposed between the front arm portion 312F and the rear arm portion 312R in the front-rear direction (i.e. direction in which the rear second wall portion 222R and the front second wall portion 222F is facing each other). Each positioning member 310 is fixed to the corresponding supporting member 300 by, for example, adhesion using an adhesive agent, welding, or fastening using a screw.

The pair of front and rear arm portions 312 of each of the positioning members 310 is engaged with the corresponding bearing member 400, thereby fixing the heating unit 101 with the above-described configuration into position in the front-rear direction with respect to the bearing member 400.

The fixing device 100 further includes a pair of left and right urging mechanisms 500 for urging the heating unit 101 toward the pressure roller 150, as illustrated in FIG. 4 (note that only the left urging mechanism 500 is illustrated in FIG. 4). That is, the left and right urging mechanisms 500 are provided at the left and right side walls 220, respectively. More specifically, each of the left and right urging mechanisms 500 is provided at upper surfaces of each pair of front and rear second wall portions 222. Incidentally, in FIG. 3, the urging mechanism 500 is not illustrated for the sake of simplicity.

Each of the left and right urging mechanism 500 includes a pivot portion 510, a pivoting arm 520, and a tension spring 530. The pivot portion 510 is provided at the upper surface of the rear second wall portion 222R. The pivoting arm 520 is pivotally movably supported by the pivot portion 510. The pivoting arm 520 is formed so as to extend frontward from the rear second wall portion 222R. The pivoting arm 520 has a substantially front-rear center portion at which a pressing portion 521 is provided. The pressing portion 521 protrudes downward from the substantially front-rear center portion of the pivoting arm 520 and is adapted to press the corresponding positioning member 310 downward. The tension spring 530 is provided on the upper surface of the front second wall portion 222F. The tension spring 530 urges a front end portion of the pivoting arm 520 downward.

Because each of the left and right urging mechanisms 500 is configured as described above, an urging force applied from each urging mechanism 500 to the heating unit 101 includes: a force component (i.e. downward force component) running from the heating unit 101 toward the pressure roller 150; and a force component (i.e. rearward force component) running from the heating unit 101 toward the rear second wall portion 222R (the second wall portion 222 disposed on a downstream side in a conveyance direction of the sheet P).

In addition, in the present embodiment, the pressure roller 150 is configured to rotate in a counterclockwise direction in a left side view, and the heating unit 101 is thereby pressed rearward by a force applied from the pressure roller 150. In other words, the rearward force applied from the pressure roller 150 is transmitted to each rear second wall portion 222R through the heating unit 101.

When the pair of urging mechanisms 500 and the pressure roller 150 apply the respective rearward forces to the heating unit 101, there may be a likelihood that the heating unit 101 including the positioning members 310 that is engageable with the corresponding bearing members 400 could tilt rearward about the bearing members 400.

Figure 6:
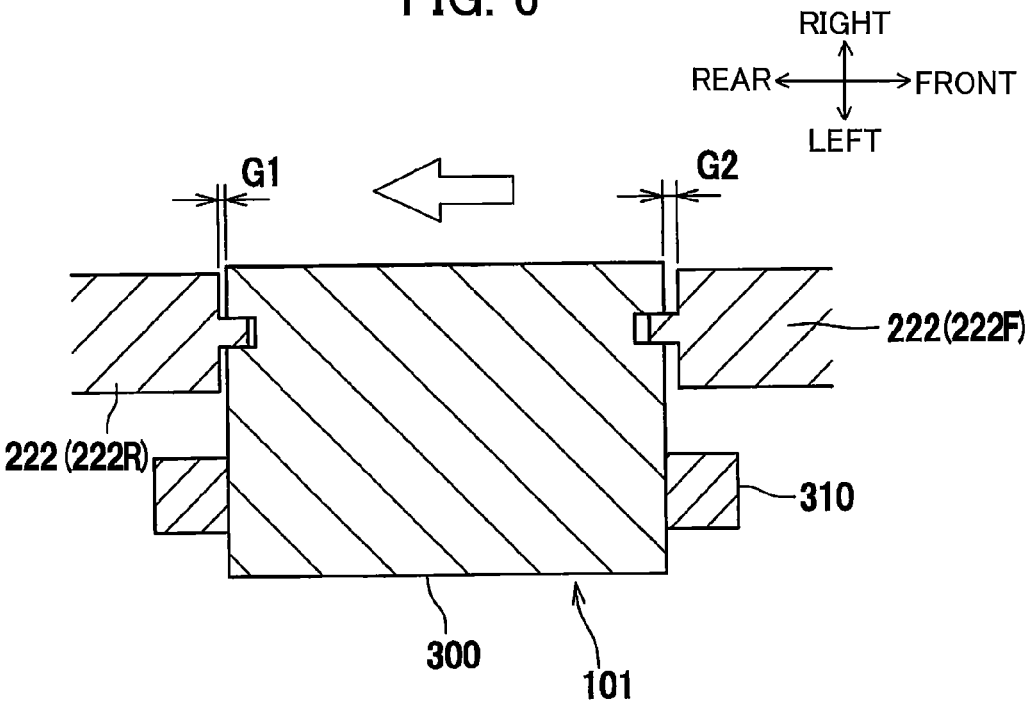
FIG. 6 is a cross-sectional view of the frame, the supporting member, and the positioning member, illustrating gaps between the support member and second wall portions of the frame.

To address this, as illustrated in FIG. 6, the frame 200 and the pair of supporting members 300 are arranged such that, in a state where no force is applied from the pair of urging mechanisms 500 or the pressure roller 150 to the heating unit 101, a first gap G1 formed between the rear second wall portion 222R and the heating unit 101 (specifically, the rear second wall portion 222R and the corresponding supporting member 300) is smaller than a second gap G2 formed between the front second wall portion 222F and the heating unit 101 (specifically, the front second wall portion 222F and the corresponding supporting member 300).

With this configuration, the urging forces (rearward forces) from the pair of urging mechanism 500 and the pressure roller 150 are received by the rear second wall portions 222R, each of which forms the smaller first gap G1 with the heating unit 101. Hence, tilting of the heating unit 101 about the bearing members 400 due to the urging forces (rearward forces) can be suppressed.

According to the above-described embodiment, the following operational advantages can be obtained in addition to the operational advantages described above.

Engagement of the positioning members 310 with the corresponding bearing members 400 provides positioning of the heating unit 101 with respect to the bearing members 400. Even if a clearance between the front second wall portion 222F and the rear second wall portion 222R becomes greater due to thermal deformation or the like, tilting of the heating unit 101 relative to the axis of the pressure roller 150 can be prevented.

<Modifications>

Various modifications and variations are conceivable. In the following description, only parts differing from those of the embodiment will be described in detail.

Figure 7:
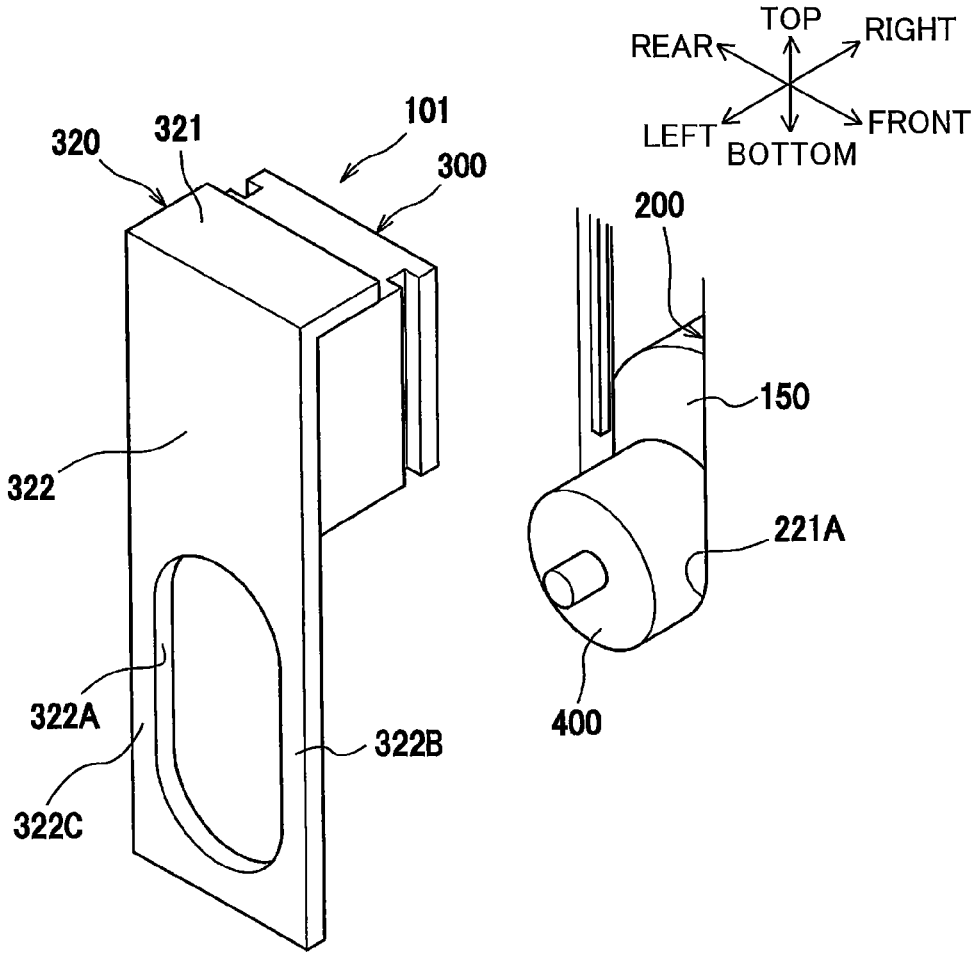
FIG. 7 is a partial perspective view of a fixing device according to one modification of the present invention, illustrating a modified positioning member and a modified frame.

The structure of the positioning member is not limited to that described in the above embodiment. For example, the heating unit 101 may include a pair of left and right positioning members 320 (as an example of a first positioning member and a second positioning member), as illustrated in FIG. 7 (only the left positioning member 320 is illustrated in FIG. 7). Each of the left and right positioning members 320 has a first planar portion 321, a second planar portion 322, and an elongated hole 322A. The first planar portion 321 is disposed on and along the upper surface of the corresponding supporting member 300. The second planar portion 322 extends downward from an outer left-right end of the first planar portion 321. More specifically, the second planar portion 322 extends further downward than the lower surface of the supporting member 300. The elongated hole 322A is formed in the second planar portion 322 and has a shape elongated in the vertical direction.

With this structure, each bearing member 400 is inserted into the corresponding elongated hole 322A. Insertion of the bearing member 400 into the corresponding elongated hole 322A allows the bearing member 400 to be interposed between a portion 322B of the second planar portion 322 located in front of the elongated hole 322A and a portion 322C of the second planar portion 322 located in rear of the elongated hole 322A, with the result that the positioning member 320 is fixed in position with respect to the corresponding bearing member 400. Hence, the heating unit 101 is fixed in position with respect to each bearing member 400.

In this modification, a combination of the first planar portion 321 and a portion of the second planar portion 322 located above the elongated hole 322A corresponds to the first base portion or the second base portion; the portion 322B and the portion 322C correspond to the pair of first arm portions or the pair of second arm portions; and a portion of the second planar portion 322 located below the elongated hole 322A corresponds to the first connecting portion or the second connecting portion.

Incidentally, in this structure, the bearing supporting portion 223 may be dispensed with. The bearing member 400 may be fixed to the corresponding concave portion 221A of the frame 200.

The structure of the urging mechanism is not limited to that described in the above embodiment. For example, instead of the tension spring 530, a different urging member such as a torsion spring may be available.

In the above-described embodiment, the heating unit 101 including the fusing belt 110, the nip plate 130, and the halogen lamp 120 is exemplified. However, the heating unit 101 may, for example, include a heating roller and a halogen lamp disposed at an internal space of the heating roller. Alternatively, the heating unit 101 may include a fusing belt, a heater disposed at an internal space of the fusing belt, a nip member disposed at the internal space of the fusing belt and nipping the fusing belt in cooperation with a pressure roller, and a heat insulating member disposed between the heater and the nip member. In the heating unit 101 with the latter structure, the heater heats the fusing belt directly.

In the above-described embodiment, the halogen lamp 120 is exemplified as the heater. However, a carbon heater or a ceramic heater may be available instead of the halogen lamp 120.

While the present invention has been described in detail with reference to the embodiments thereof, it would be apparent to those skilled in the art that various changes and modifications may be made therein without departing from the spirit of the present invention.

What is claimed is:

1. A fixing device comprising:

a heating unit;

a rotatable body, the rotatable body and the heating unit being configured to form a nip region therebetween where a sheet is to be conveyed by at least the rotatable body in a conveyance direction;

a bearing supporting the rotatable body rotatably;

a frame including:

a first wall portion supporting the bearing;

a second wall portion; and a third wall portion, the heating unit being interposed between the second wall portion and the third wall portion, the heating unit being movably guided between the second wall portion and the third wall portion along a direction from the heating unit toward the rotatable body; and a positioning member extending from the heating unit in a direction from the heating unit toward the rotatable body, the positioning member having a portion aligned with the bearing in the conveyance direction, the portion aligned with bearing in the conveyance direction being configured to be engaged with the bearing, wherein the second wall portion is spaced apart from the third wall portion in the conveyance direction to form a gap between the second wall portion and the third wall portion, wherein the heating unit includes a portion disposed inside the gap between the second wall portion and the third wall portion to be guided by the second wall portion and the third wall portion, and wherein the heating unit has:

a first guide groove, the second wall portion having a portion disposed inside the first guide groove; and a second guide groove, the third wall portion having a portion disposed inside the second guide groove.

2. The fixing device as claimed in claim 1, further comprising an urging mechanism configured to urge the heating unit toward the rotatable body, the urging mechanism being configured to generate an urging force including a first force component running from the heating unit toward the rotatable body and a second force component running from the heating unit toward the second wall portion, and wherein the heating unit and the second wall portion define a first gap, and the heating unit and the third wall portion define a second gap, the first gap being smaller than the second gap.

3. The fixing device as claimed in claim 1, wherein the second wall portion is configured to receive, through the heating unit, a force applied from the rotatable body, and wherein the heating unit and the second wall portion define a first gap, and the heating unit and the third wall portion define a second gap, the first gap being smaller than the second gap.

4. The fixing device as claimed in claim 1, wherein the positioning member includes a base portion and a connecting portion both connected to the portion of the positioning member aligned with the bearing in the conveyance direction, the connecting portion being disposed opposite to the base portion with respect to the bearing.

5. The fixing device as claimed in claim 1, wherein the first wall portion includes a bearing supporting portion configured to support the bearing.

6. The fixing device as claimed in claim 5, wherein the bearing supporting portion includes a peripheral-surface supporting portion having an arcuate shape that conforms to a peripheral surface of the bearing, the peripheral-surface supporting portion having a pair of grooves configured to allow the positioning member aligned with the bearing in the conveyance direction to be engaged with the bearing.

7. The fixing device as claimed in claim 1, wherein the positioning member is a U-shaped member.

8. The fixing device as claimed in claim 1, wherein the rotatable body includes a roller.

9. The fixing device as claimed in claim 8, wherein the heating unit includes an endless belt, the endless belt and the roller being configured to form the nip region therebetween.

10. The fixing device as claimed in claim 9, wherein the portion of the positioning member aligned with the bearing in the conveyance direction is aligned with the roller in a direction parallel to an axis of the roller.

11. A fixing device comprising:

a heating unit including an endless belt;

a roller, the roller and the endless belt being configured to form a nip region therebetween where a sheet is to be conveyed in a conveyance direction;

a bearing supporting the roller rotatably;

a frame including:

a first wall portion supporting the bearing;

a second wall portion; and a third wall portion, the heating unit being interposed between the second wall portion and the third wall portion, the heating unit being movably guided between the second wall portion and the third wall portion along a direction from the heating unit toward the roller; and a positioning member extending in a direction from the heating unit toward the roller, the positioning member having a portion overlapping the bearing when viewed in the conveyance direction, the portion of the positioning member being configured to be engaged with the bearing, wherein the second wall portion is spaced apart from the third wall portion in the conveyance direction to form a gap between the second wall portion and the third wall portion, wherein the heating unit includes a portion disposed inside the gap between the second wall portion and the third wall portion to be guided by the second wall portion and the third wall portion, and wherein the heating unit has:

a first guide groove, the second wall portion having a portion disposed inside the first guide groove; and a second guide groove, the third wall portion having a portion disposed inside the second guide groove.

12. The fixing device as claimed in claim 11, wherein the portion of the positioning member overlaps with the roller when viewed in a direction parallel to an axis of the roller.

13. The fixing device as claimed in claim 11, further comprising an urging mechanism configured to urge the heating unit toward the roller, the urging mechanism being configured to generate an urging force including a first force component running from the heating unit toward the roller and a second force component running from the heating unit toward the second wall portion, and wherein the heating unit and the second wall portion define a first gap, and the heating unit and the third wall portion define a second gap, the first gap being smaller than the second gap.

14. The fixing device as claimed in claim 11, wherein the second wall portion is configured to receive, through the heating unit, a force applied from the roller, and wherein the heating unit and the second wall portion define a first gap, and the heating unit and the third wall portion define a second gap, the first gap being smaller than the second gap.

15. The fixing device as claimed in claim 11, wherein the positioning member includes a base portion and a connecting portion both connected to the portion of the positioning member overlapping the bearing when viewed in the conveyance direction, the connecting portion being disposed opposite to the base portion with respect to the bearing.

16. The fixing device as claimed in claim 11, wherein the positioning member is a U-shaped member.

17. The fixing device as claimed in claim 11, wherein the first wall portion includes a bearing supporting portion configured to support the bearing.

18. The fixing device as claimed in claim 17, wherein the bearing supporting portion includes a peripheral-surface supporting portion having an arcuate shape that conforms to a peripheral surface of the bearing, the peripheral-surface supporting portion having a pair of grooves configured to allow the portion of the positioning member overlapping with the bearing when viewed in the conveyance direction to be engaged with the bearing.

* * * * *